US009962005B2

(12) United States Patent
Salin

(10) Patent No.: US 9,962,005 B2
(45) Date of Patent: May 8, 2018

(54) BED OR MATTRESS

(71) Applicant: Roberto Salin, Bolzano (IT)

(72) Inventor: Roberto Salin, Bolzano (IT)

( * ) Notice: Subject to any disclaimer, the term of this patent is extended or adjusted under 35 U.S.C. 154(b) by 159 days.

(21) Appl. No.: 14/777,599

(22) PCT Filed: Mar. 17, 2014

(86) PCT No.: PCT/EP2014/055246

§ 371 (c)(1),
(2) Date: Sep. 16, 2015

(87) PCT Pub. No.: WO2014/147003

PCT Pub. Date: Sep. 25, 2014

(65) Prior Publication Data

US 2016/0296029 A1 Oct. 13, 2016

(30) Foreign Application Priority Data

Mar. 18, 2013 (IT) ..... BZ2013A0017

(51) Int. Cl.

| | |
|---|---|
| ***A47C 19/04*** | (2006.01) |
| ***A47C 17/26*** | (2006.01) |
| ***A47C 19/02*** | (2006.01) |
| ***A47C 17/84*** | (2006.01) |
| ***A47C 31/00*** | (2006.01) |

(52) U.S. Cl.

CPC ..... *A47C 19/02* (2013.01); *A47C 17/26* (2013.01); *A47C 17/84* (2013.01); *A47C 19/04* (2013.01); *A47C 19/045* (2013.01); *A47C 31/00* (2013.01)

(58) Field of Classification Search

CPC ..... A47C 19/02; A47C 19/04; A47C 19/045; A47C 17/26; A47C 17/84; A47C 31/00

See application file for complete search history.

(56) References Cited

U.S. PATENT DOCUMENTS 1,945,875 A * 2/1934 Woller ..... A47C 17/84 292/281
2,112,355 A * 3/1938 Archer ..... A47C 17/84 5/10.2

(Continued)

FOREIGN PATENT DOCUMENTS

CH 172 027 9/1934
CH 172027 A * 9/1934 ..... A47C 17/28

(Continued)

OTHER PUBLICATIONS

International Search Report dated Jun. 16, 2014.

*Primary Examiner* — Nicholas F Polito
*Assistant Examiner* — Rahib T Zaman
(74) *Attorney, Agent, or Firm* — Jacobson Holman, PLLC

(57) ABSTRACT

A bed is described having a mattress or mattress, wherein the mattress has at least two rests arranged on two sides of the mattress parallel to each other, the rests being adapted to be arranged on respective lifting mechanisms intended to bring the mattress into a position such that it can be rotated on itself by 180° about a horizontal axis. According to the invention, the rest support is formed by two extendible elements which converge to form a joint with lower ends attached to the frame at a distance, the floor or the ceiling and at whose top a support is formed for the rests.

6 Claims, 11 Drawing Sheets

(56) References Cited

U.S. PATENT DOCUMENTS

| | | | | | |
|---|---|---|---|---|---|
| 2,575,189 | A * | 11/1951 | Schmidt | A47D 9/005 | 280/43 |
| 3,829,912 | A * | 8/1974 | Quakenbrush | B60P 3/38 | 5/10.2 |
| 4,856,129 | A * | 8/1989 | Butler | A61G 7/005 | 108/8 |
| 5,984,404 | A * | 11/1999 | Novoa | A47C 17/84 | 296/190.01 |
| 6,711,765 | B1 * | 3/2004 | Mitchell, III | A47C 19/04 | 403/203 |
| 6,851,376 | B2 * | 2/2005 | D'Agostino | A47B 51/00 | 108/147 |
| 7,377,362 | B2 * | 5/2008 | Blodgett, Jr. | B60P 3/39 | 187/222 |
| 7,802,840 | B1 * | 9/2010 | Shea | B60P 3/39 | 296/190.02 |
| 2003/0041377 | A1 * | 3/2003 | Bailey | B25J 9/08 | 5/118 |
| 2009/0255056 | A1 * | 10/2009 | Burnett | A47C 17/86 | 5/11 |
| 2010/0223722 | A1 * | 9/2010 | Burnett | A47C 17/86 | 5/11 |
| 2011/0265269 | A1 | 11/2011 | Scarleski | | |

FOREIGN PATENT DOCUMENTS

| | | |
|---|---|---|
| DE | 517 605 | 2/1931 |
| DE | 846 157 | 8/1952 |
| DE | 867 906 | 2/1953 |
| DE | 28 12 420 | 9/1979 |
| EP | 1 396 214 | 3/2004 |
| GB | 2 276 315 | 9/1994 |
| WO | 2006/055005 | 5/2006 |

* cited by examiner

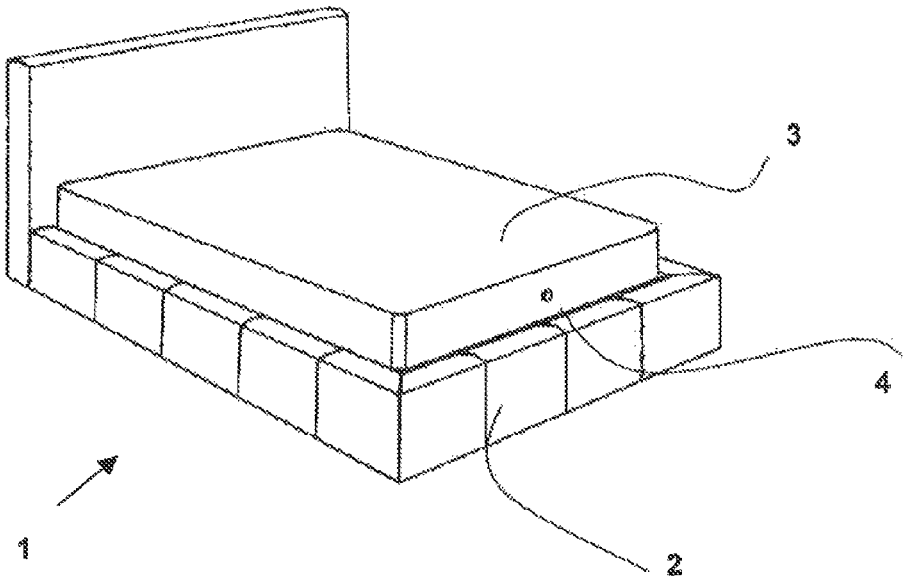
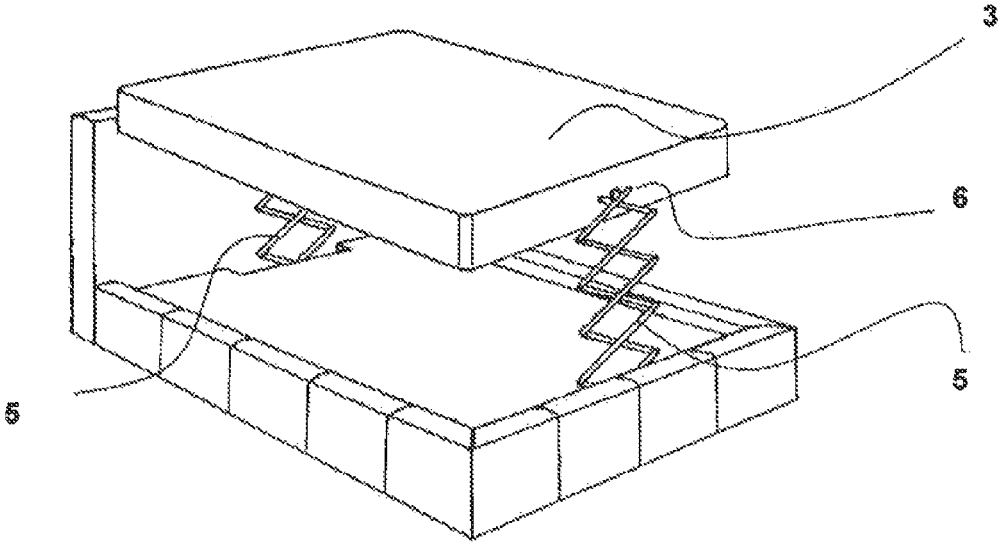
Fig. 2

Fig. 3
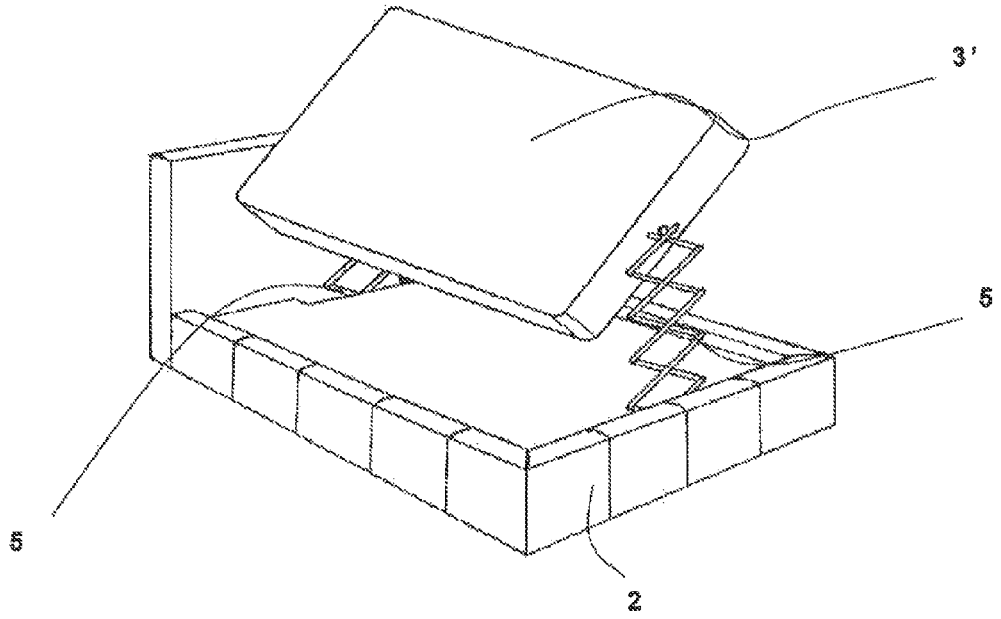
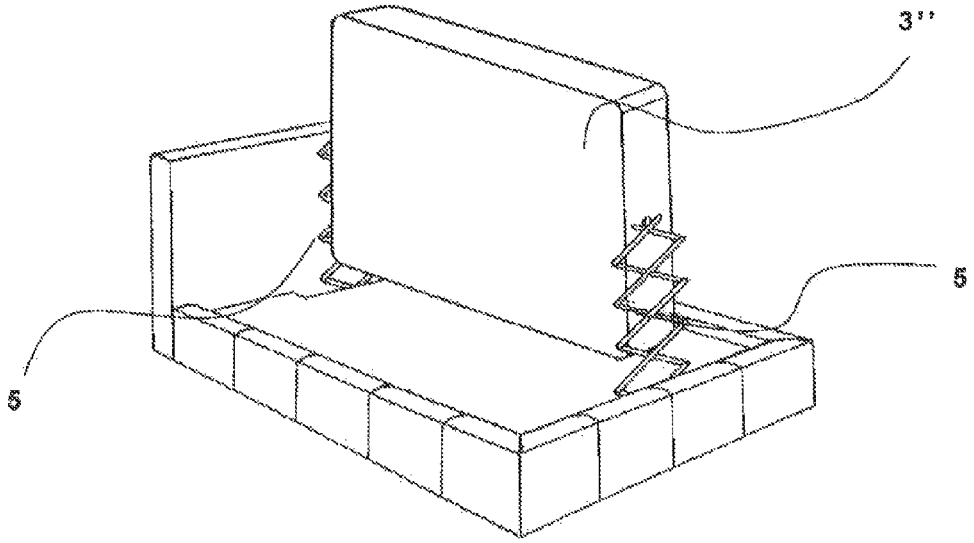
Fig. 4

BED OR MATTRESS

The present invention relates to a bed having a mattress.

BACKGROUND OF THE INVENTION

For beds of this type there is a need to be able to vary the surface facing the sleeper. This is both to change the transpiration position and to vary the load to which the mattress is subjected.

In Patent Application US 2011/0265269 a device is described to facilitate mattress rotation in an horizontal plane on springs or a platform about a vertical axis. This device is completed by elements adapted to allow the rotation of the mattress about a vertical axis hence making it possible to change the head part of the mattress with the foot part and vice versa.

However, this publication does not solve the problem of being able to easily change the upper side of the mattress with the lower one and vice versa. This option is useful both to aerate the mattress and to vary the load to which the actual side is subject. Up to now this mattress rotation movement has been performed by the user or, in hospitals for example, by the staff. The object of the present invention is to facilitate as much as possible the intervention of the user or the staff when making the bed or changing the mattress position, by offering a bed or mattress which can be put in a position so as to facilitate the rotation of the mattress by 180° in order to exchange the two faces of the mattress itself.

BRIEF SUMMARY OF THE INVENTION

This object is achieved by a bed with the identifying characteristics of claim 1.

The mattress has rests arranged on two parallel sides of the mattress and can be arranged on respective lifting means adapted to bring the mattress into a position that allows it to be rotated about itself by 180° possibly with the chance to translate the mattress itself. It is clear that two rests are preferably on a longitudinal axis of rotation of the mattress in order to allow minimal lifting.

According to the invention, the support for the rest is formed by two sliding rods into which the guides converge with lower ends attached to the frame at a distance, the container or the floor and at whose top a rest support is formed.

These guides can be formed by profiles in which they are slidably housed by rods which are articulated to one another with a joint at their free ends in the converging point.

However, the same guides could also consist of cylinders in which stems forming the above-mentioned rods slide.

When the rods or respectively the stems are extracted, the joint on which the mattress frame or the mattress or its reinforcement rests or is connected is raised until it reaches a suitable height, in order to allow the 180° rotation of the mattress or its frame.

In a preferred embodiment, on top of the joint between the two rods or stems an articulated parallelogram is formed one articulation of which is the joint.

Between said joint and the articulation opposite it, a rope-shaped or cord-shaped wire is arranged or stretched which is attached on one side to the opposite articulation and on the other to a rotating body or drum whose axis is integral to the axis of the mattress frame or the actual mattress and can be wound along a perimeter stretch of 180° about the rotating body or drum to a completely stretched position of the winding wire.

In one embodiment, from the longitudinal opposite sides of the frame from the side itself, a rail or a plate respectively can be extracted perpendicularly to said side in order to cooperate with a castor supported by an arm of each guide or by the cylinder to be taken from a retracted position to an active resting position on a single plate per side of the mattress in order to be able to incline the bed base along with the mattress with respect to the floor to sleep in an inclined position.

Conveniently, in an embodiment the bed frame is equipped with four telescopic feet which can be locked and unlocked in a known way, so that, once the height required to make the bed has been determined, it being stable on appropriately locked feet, the lifting mechanism is lowered reaching a resting position so that the bed can be made.

In another embodiment the lifting means is formed by flexible elements attached at their lower ends to the rests and whose upper ends can be wound onto and unwound from a drum arranged on the ceiling and moved by an actuator. The flexible elements may be ropes, chains, cords and belts.

In one embodiment, to form the rests a longitudinal axis is envisaged at whose ends pulleys or pins forming the support are provided.

In order to prevent the mattress from becoming floppy when lifted, inside it at least one insert is provided as reinforcement between the mattress faces and it is equipped respectively with a support at points close to the two parallel sides of the mattress. The reinforcement can be provided in other known ways, not depicted in the drawing, also external to the mattress.

BRIEF DESCRIPTION OF THE SEVERAL VIEWS OF THE DRAWINGS(S)

Further characteristics and details will become clear from the claims and from the following description of the embodiments and variations shown in the appended drawing, by way of a non-limitative example, in which:

FIG. 1 is a schematic perspective view of a bed according to the invention.

FIG. 2 is a schematic perspective view like FIG. 1, but in a raised position of the mattress, arranged horizontally.

FIG. 3 is a view like the previous ones, but with the mattress in an inclined position.

FIG. 4 is a view like the previous ones, but with the mattress in an vertical position.

FIG. 6 is a schematic perspective view of a mattress according to the invention in a third embodiment.

DETAILED DESCRIPTION OF THE INVENTION

Figure 5:
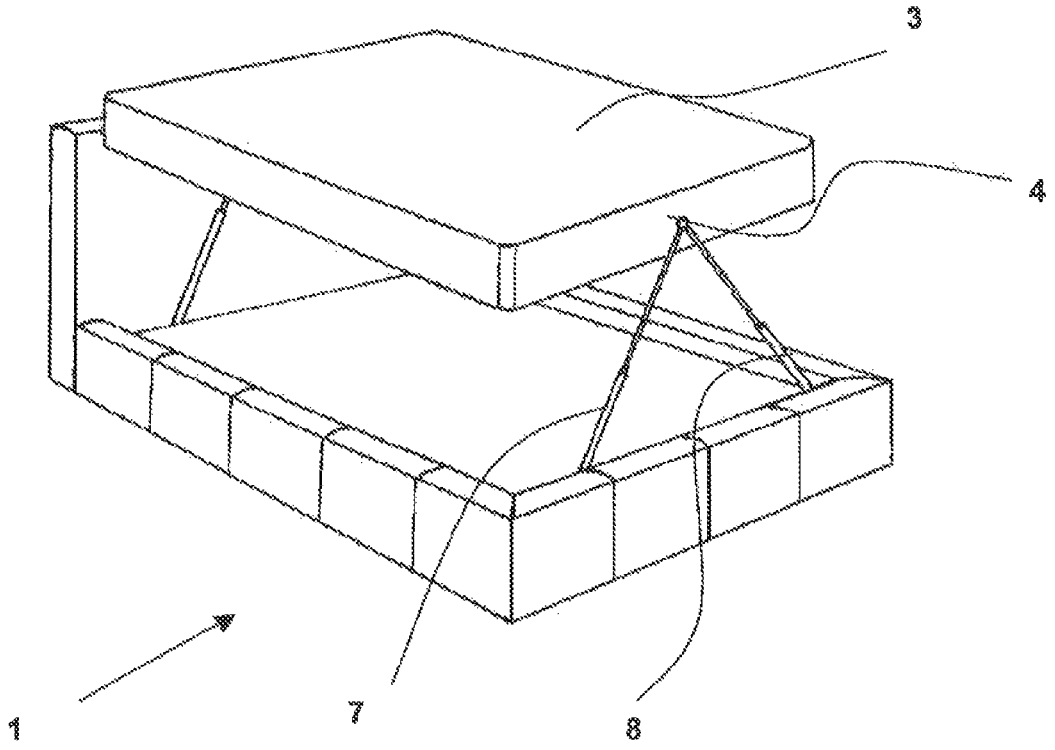
FIG. 5 is a schematic perspective view of a second embodiment.

In FIGS. 1 to 11, reference number 1 designates a bed according to the invention as a whole. Bed 1 consists of a frame 2 and a mattress 3.

Mattress 3 according to the invention is equipped on the two transversal parallel sides, in an intermediate position, with a pin 4, respectively.

Pin 4 in a first embodiment acts as support to a pantograph 5 at its top, while its lower end is invisibly connected to a special actuator adapted to clasp its parallelograms.

Instead of a pantograph 5, the lifting means may be formed by fluid dynamic cylinders, such as hydraulic or pneumatic ones 7 and 8, which are attached at their lower ends to the frame or the floor with or without intermediate connections at a distance from each other, and converge into a top vertex which acts as a support for the pins 4.

However, the lifting means can be formed in a third embodiment by two ropes 9 and 10 which can be wound and unwound, for example, onto or from a drum—not shown—applied to the ceiling of a building or a room and equipped with a special actuator, which is not shown either.

Figure 7:
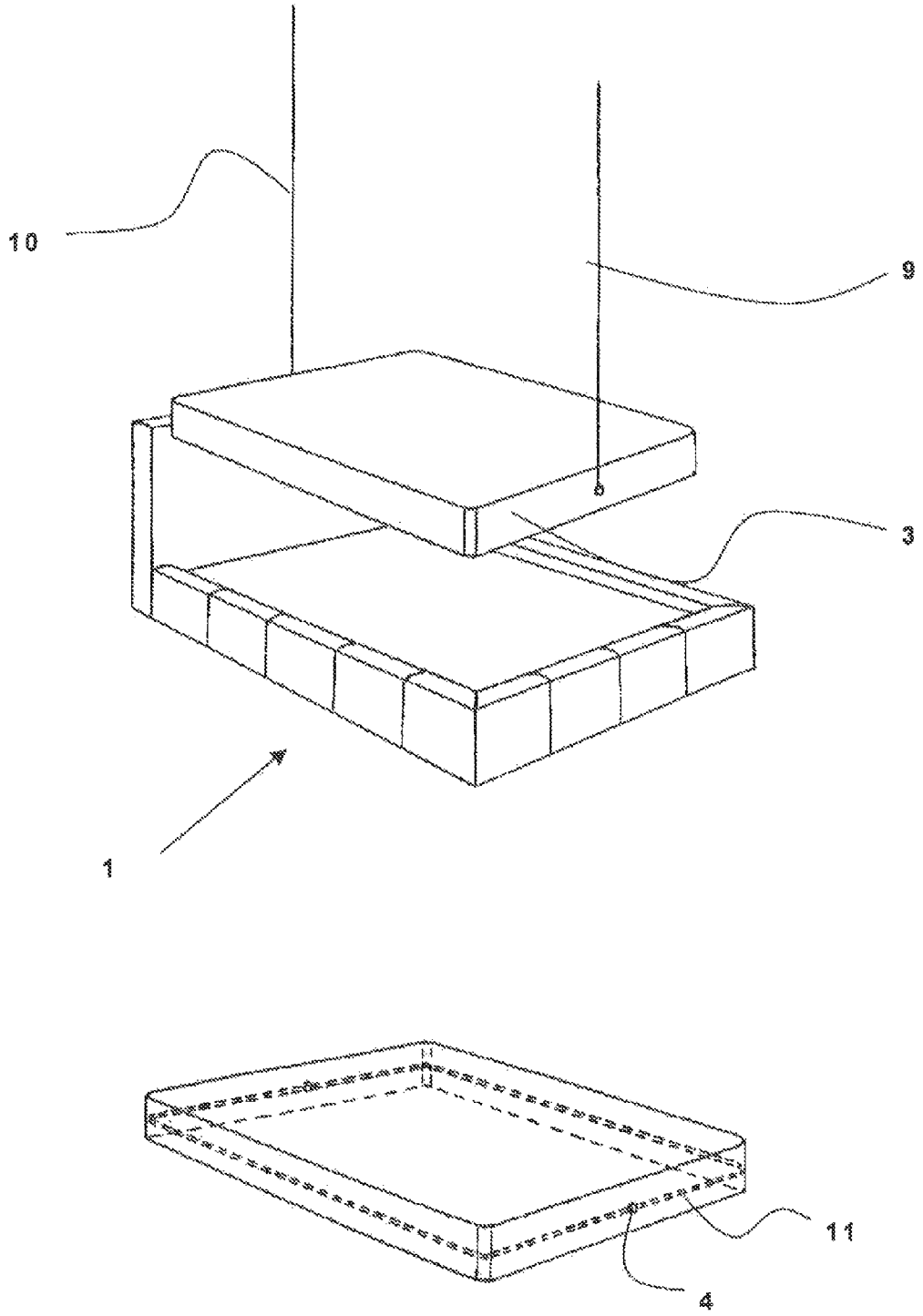
FIG. 7 is an embodiment of a mattress according to the invention.
Figure 8:
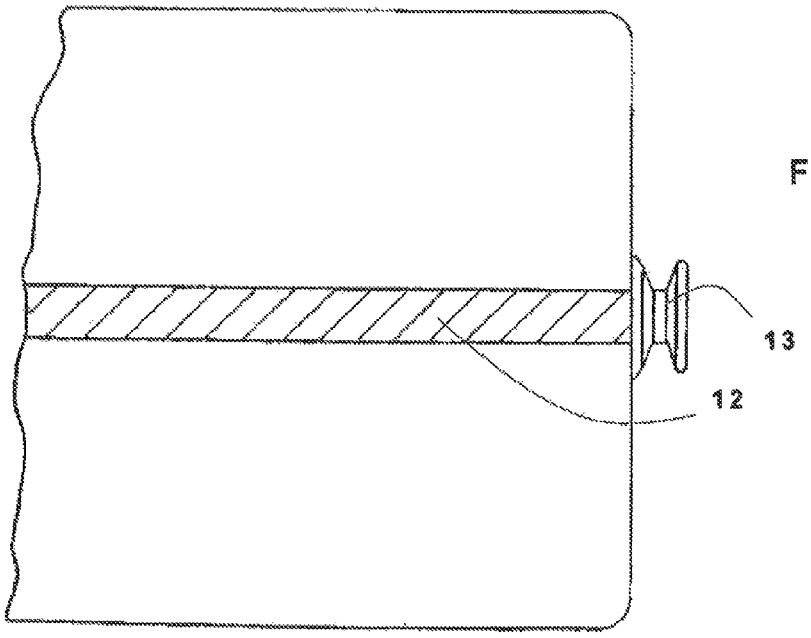
FIG. 8 is a section of a mattress according to the invention in an embodiment.

As shown in FIG. 7, on an intermediate plane 11 of mattress 3 a panel 12 can be provided, as shown in FIG. 8, at whose ends pulleys 13 acting as rests are envisaged. The axis of rotation may be a tube, a bar or part of a panel.

Figure 9:
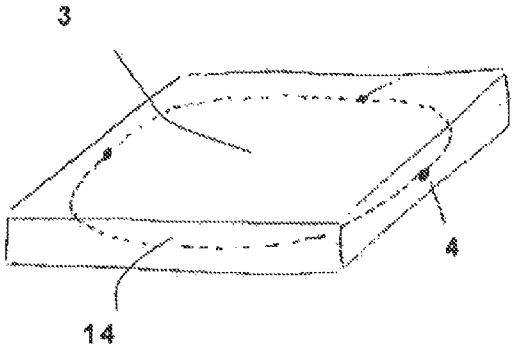
FIGS. 9 and 10 are respectively a perspective and a top view of the mattress in another embodiment.
Figure 10:
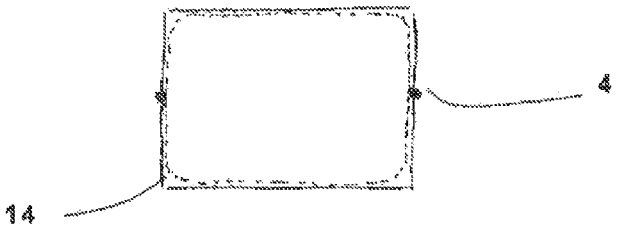
Figure 11:
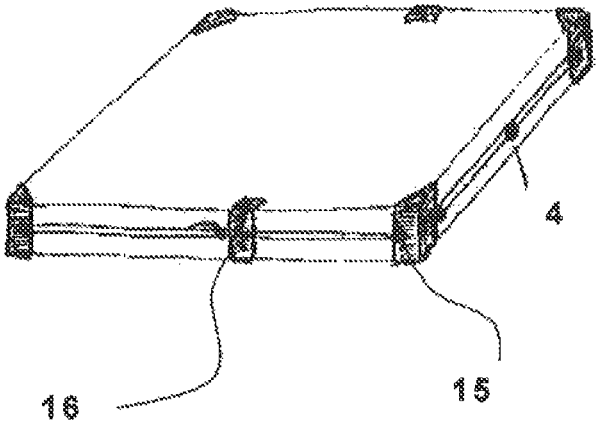
FIG. 11 is a traditional mattress in an embodiment adapted to the mattress according to the invention.
Figure 12:
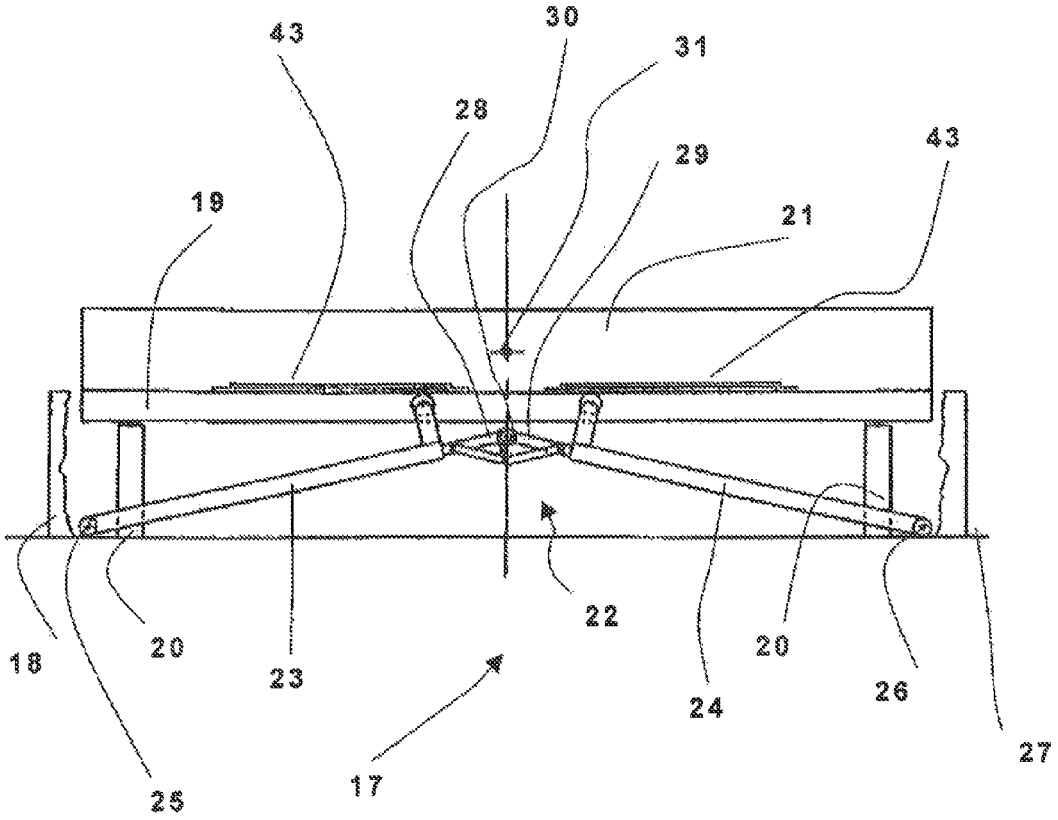
FIG. 12 is a schematic side view of a bed in use position in another embodiment.

As shown in FIGS. 9, 10 and 11 in an intermediate plane an insert 14 could also be introduced to stiffen the mattress itself and therefore help preventing the mattress from becoming floppy when lifted. The insert can be formed by at least one panel, a ring or compressed air or pressurised oil chambers.

In FIG. 11, along the sides the thickness of the mattress 3 is reinforced by means of angle brackets 15 and clips 16 connected to each other, the mattress being equipped with rests or pins 4.

In FIGS. 12 to 18 a particularly preferred further embodiment is shown.

In this example, bed 17 comprises a bed container 18, a frame 19 supported by feet 20 and a mattress 21. Bed 17 is associated with a lifting mechanism 22. This is formed by a cylinder 23 and 24 respectively connected with their bases by means of articulations 25 and 26 to the floor 27 or to feet 20 or to the bed container 18. From cylinders 23 and 24 stems 28 and 29 can be extracted in a known way. Stems 28 and 29 converge into a joint 30 adapted to cooperate with a pin 31 forming an intermediate rotation axis of the mattress 21.

Each foot 20 is preferably formed by at least one telescopic segment 32.

According to the invention, joint 30 is part of an articulated parallelogram 33 and is opposite an articulation 34 of the articulated parallelogram 33. The joint 30 is connected by means of a wire 35 to articulation 34. This wire can be wound onto a pulley 36 rotatable in the joint 30. The wire 35 can be wound by a winding angle 37 which corresponds to a 180° rotation. The length of the wire 35 is sized so that the wire itself is stretched in the position in which the wire winding portion on the pulley 36 is at 180° to be completely unwound bringing the mattress into its highest position by means of the lifting mechanism 22.

Preferably each cylinder 23, 24 at the stems 28, 29, is equipped with at least one arm 38 and 39 respectively which each supports at its own free end at least one castor 40 and 41 respectively adapted to cooperate with a plate 42, when it is extracted from a pocket 43 provided on the upper side of a profile 44 of the frame 19.

Figure 13:
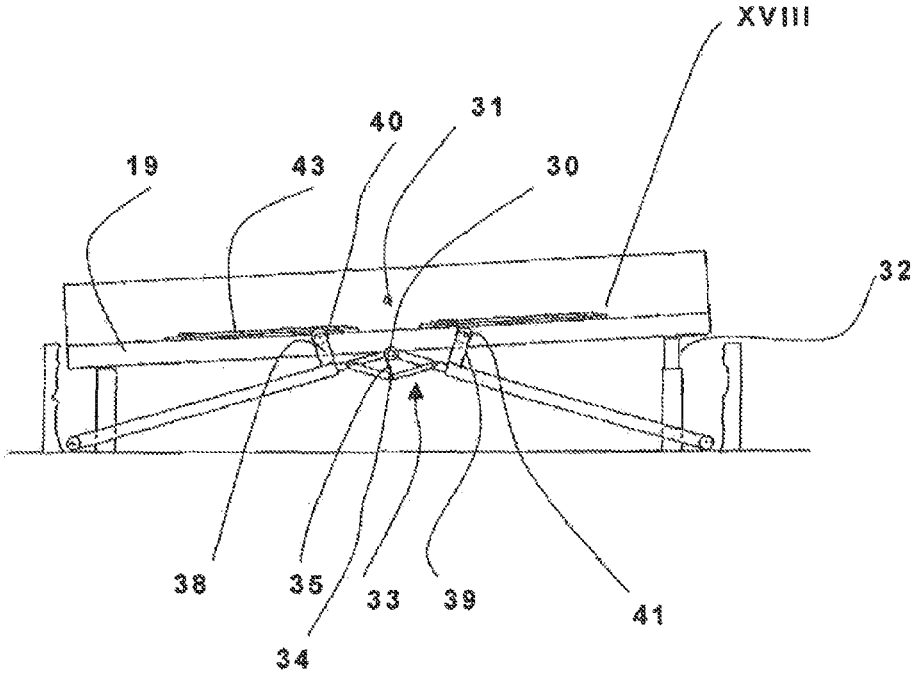
FIG. 13 is the same bed as FIG. 12 in an in lined position.
Figure 14:
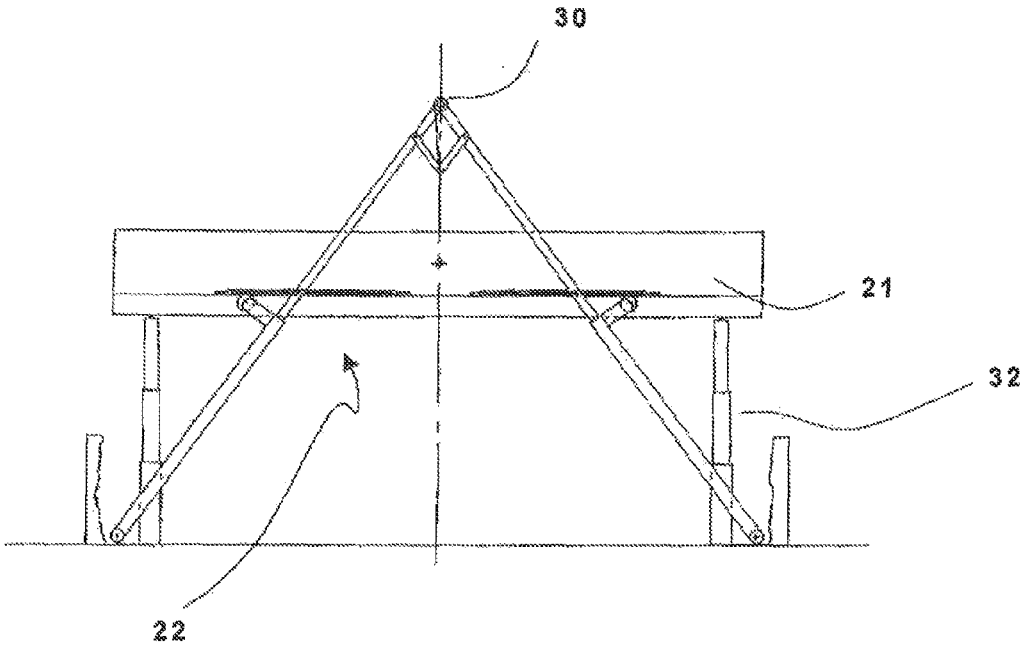
FIG. 14 shows the bed of FIG. 12 in a raised position with extracted feet.
Figure 15:
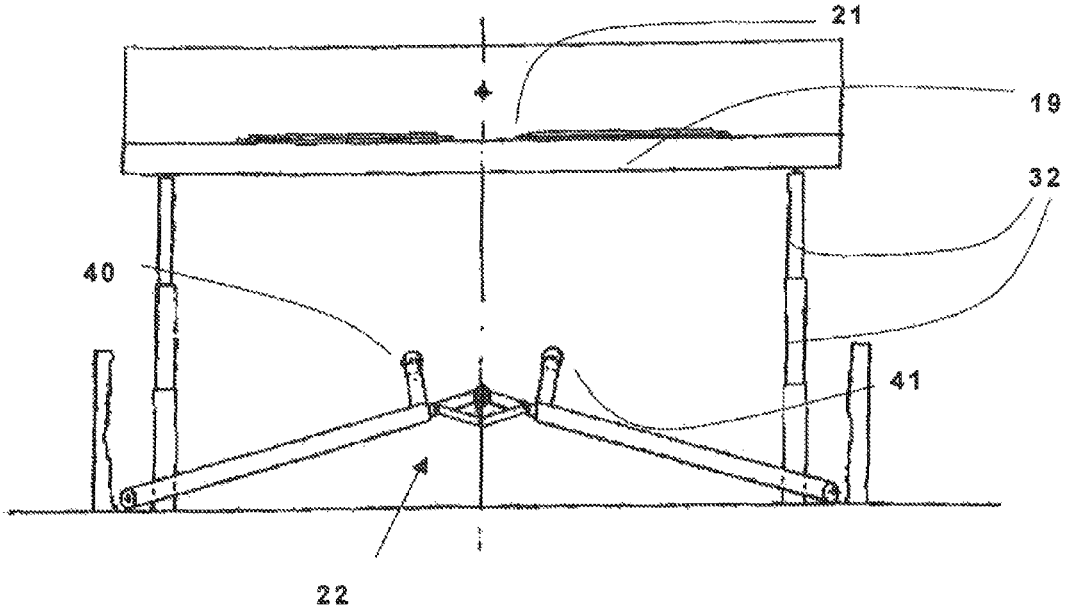
FIG. 15 is the bed of FIG. 12 with the mattress supported by the extended feet and the lifting mechanism at rest.
Figure 16:
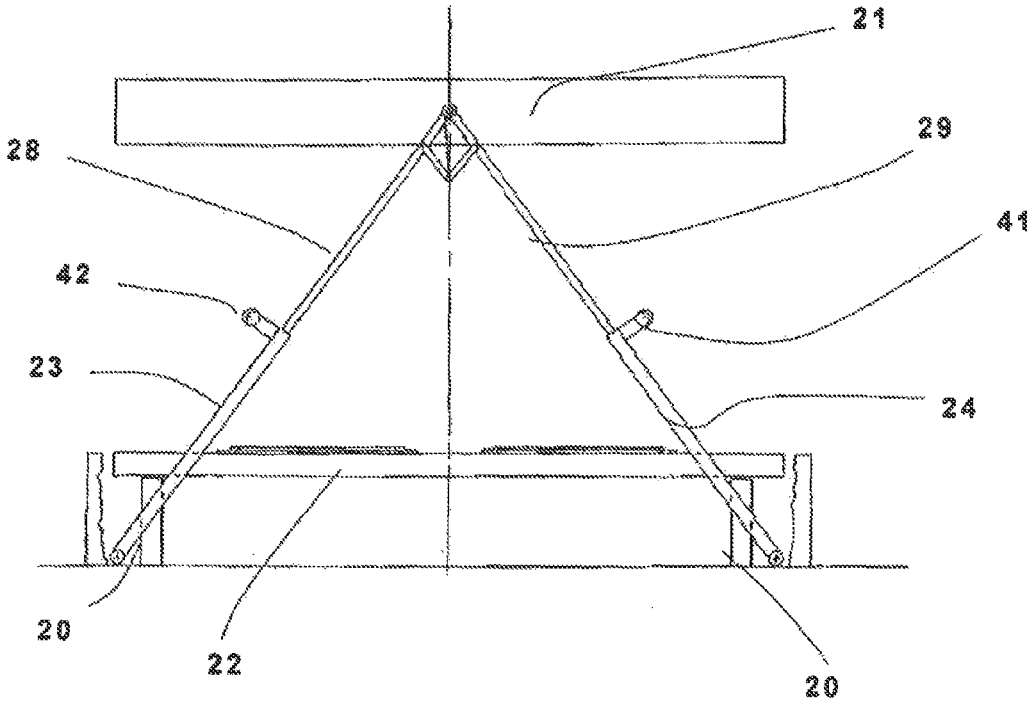
FIG. 16 shows the bed of FIG. 12 in a position adapted to rotate the mattress.
Figure 17:
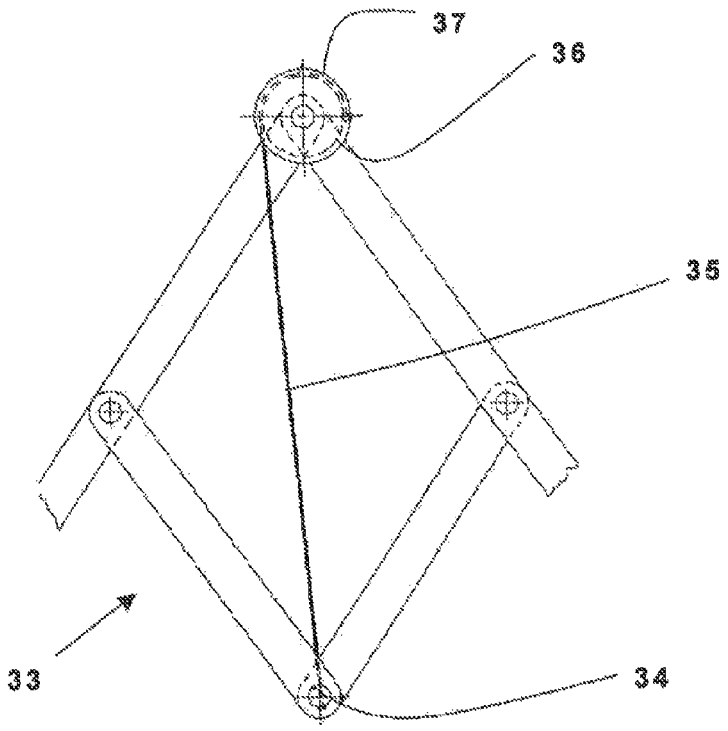
FIG. 17 shows a detail of the lifting mechanism of FIGS. 12 to 16 with the lifting mechanism for the automatic 180° rotation of the mattress.
Figure 18:
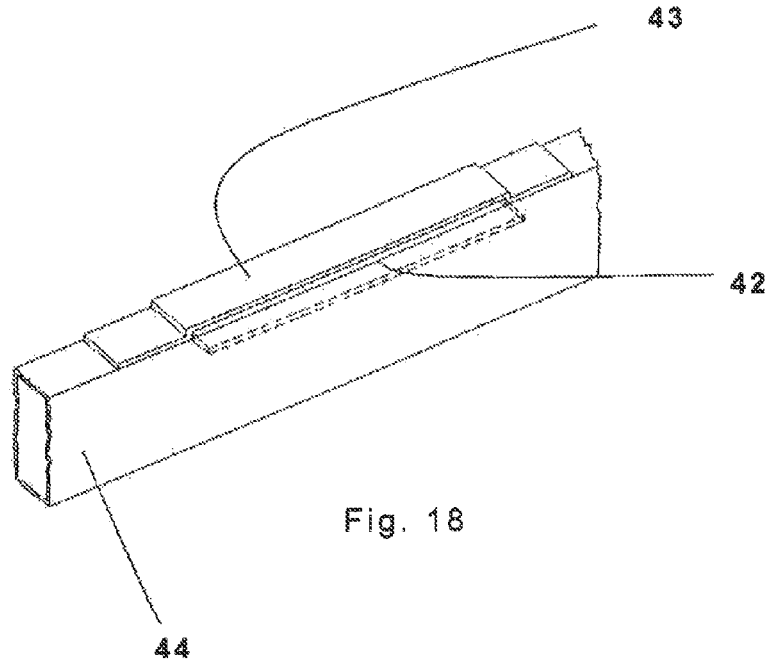
FIG. 18 shows detail XVIII in a perspective view of FIG. 13.

In FIG. 13 the lifting of a bed mattress/bed base/mattress is shown only on one side: to do so, the lifting mechanism 22 is activated after taking out from a single pocket corresponding to the side to be lifted a single plate 42, which is brought along with the telescopic elements 32 at the plate itself up to the desired height.

By returning the lifting mechanism 22 to its resting position and putting the plate 42 back inside, the inclined bed can be used for sleeping because the telescopic segments or elements 32 are locked in a known way by a locking element until they are unlocked.

The operation of this embodiment can be preferably described as follows:

when it is necessary to make the bed 17, the lifting mechanism 22 intervenes by extracting stems 28 and 29. While lifting, when joint 30 does not yet cooperate with the pin 31 and the plates 42 are extracted and supported by the castors 40 and 41, the frame 19 is lifted together and in a convenient position also for the extraction of the telescopic segments 32 from the feet 20 the bed 17 can be unmade after locking the feet and lowering the lifting mechanism to its resting position. Returning the pockets 43 and the plates 42, the joint 30 can come into contact with the pin 31 of mattress 21 up to the maximum extraction height of the lifting mechanism 22 which, when correctly sized, corresponds to the appropriate height adapted to rotate the mattress. As soon as the mattress 21 has been rotated, the lifting mechanism 22 can be lowered to its resting position and it is brought to a resting position and the plates 42 are extracted from the pockets 43.

The lifting mechanism 22 intersects with castors 40 and 41 in contact with the plates 42, lifting the frame 19 and mattress 21, bringing them to a suitable position for making the bed with the feet locked.

After lowering the lifting mechanism 22, the bed can be made. The lifting mechanism 22 is then brought back with the castors 40 and 41 into contact with the plates 42 and the frame 19 of the mattress is slightly raised to then be lowered unlocking the feet in a retracted position.

It is clear that within the above-described embodiment various options are possible without departing from the scope of the invention. Therefore, the cylinders could be guides in which rods slide that converge into said joint.

KEY OF REFERENCE NUMBERS

1. bed
2. frame
3. mattress
4. rest (pin)
5. pantograph
6. top
7. cylinder
8. cylinder
9. rope
10. rope
11. intermediate plane
12. axis (panel)
13. pulley

14, insert
15. angle brackets
16. clips
17. bed
18. bed container
19. frame
20. feet
21. mattress
22. lifting mechanism
23. cylinder
24. cylinder
25. articulation
26. articulation
27. floor
28. stem
29. stem
30. joint
31. pin
32. telescopic segment
33. articulated parallelogram
34. articulation
35. wire
36. pulley
37. winding angle
38. arm
39. arm
40. castor
41. castor
42. plate
43. pocket
44. frame profile

The invention claimed is:

1. A bed with a mattress or a mattress comprising: at least two rests arranged on two sides parallel to each other of a mattress, the rests being adapted to be arranged on respective lifting mechanisms intended to bring the mattress into a position such that it can be rotated by 180° on itself about a horizontal axis, wherein a support for the rest is formed by two extendible elements which converge to form an articulation with lower ends attached to a frame at a distance, a floor or a ceiling and the lifting mechanisms are associated with the bed, formed by cylinders respectively connected with their bases to the floor by means of articulations; stems extending from the cylinders, the stems converging into a joint adapted to cooperate with a median axis of rotation of the mattress and wherein the joint is part of an articulated parallelogram and is opposite an articulation of the articulated parallelogram and is connected by means of a wire to the articulation, the wire being able to be wound around a pulley rotatable in the joint and being able to be wound by a winding angle which corresponds to a 180° rotation, a length of the wire being sized so that the wire itself is stretched in the position in which a winding portion of the wire on the pulley is at 180° to be fully unwound bringing the lifting mechanisms into their highest position.

2. The bed or mattress according to claim 1, wherein the rests are on a longitudinal axis of rotation of the mattress.

3. The bed or mattress according to claim 1, wherein the rests comprise an axis having a pulley at each of its ends.

4. The bed or mattress according to claim 3, wherein the axis is a tube or a bar.

5. The bed or mattress according to claim 1, wherein each foot is formed by at least one telescopic segment which can be positioned.

6. The bed or mattress according to claim 1, wherein at the stems each cylinder is equipped with at least one arm which each supports at its own free end at least one castor adapted to cooperate with a plate, when it is extracted from a pocket present on an upper side of a profile of the frame.

* * * * *